United States Patent [19]

Leisenberg

[11] 4,283,170

[45] Aug. 11, 1981

[54] METHOD OF FIRING A TUNNEL KILN WITH COAL, AND COAL FIRING INSTALLATION FOR TUNNEL KILNS

[76] Inventor: Manfred Leisenberg, Giessener Strasse 46, 6312 Laubach, Hessen, Fed. Rep. of Germany

[21] Appl. No.: 73,638

[22] PCT Filed: Dec. 22, 1978

[86] PCT No.: PCT/DE78/00042

§ 371 Date: Sept. 10, 1979

§ 102(e) Date: Sept. 10, 1979

[87] PCT Pub. No.: WO79/00492

PCT Pub. Date: July 26, 1979

[30] Foreign Application Priority Data

Jan. 12, 1978 [DE] Fed. Rep. of Germany ..... 2801193

[51] Int. Cl.[3] ..... F27D 7/00; F27B 9/26; F23K 3/02

[52] U.S. Cl. ..... 432/1; 110/104 R; 110/105; 110/165 R; 432/25; 432/137; 432/138

[58] Field of Search ..... 432/1, 25, 137, 138; 110/104 R, 165 R, 105

[56] References Cited

U.S. PATENT DOCUMENTS

| | | | |
|---|---|---|---|
| 1,437,342 | 11/1922 | Griggs et al. | 110/105 |
| 2,342,039 | 2/1944 | Davis | 198/141 |
| 2,693,775 | 11/1954 | Berry | 110/165 |
| 4,092,094 | 5/1978 | Lingl | 110/104 R |

FOREIGN PATENT DOCUMENTS

| | | |
|---|---|---|
| 443466 | 4/1927 | Fed. Rep. of Germany . |
| 905473 | 3/1954 | Fed. Rep. of Germany . |
| 1757836 | 6/1971 | Fed. Rep. of Germany . |
| 2108380 | 9/1972 | Fed. Rep. of Germany . |
| 144763 | 7/1920 | United Kingdom . |

*Primary Examiner*—John J. Camby
*Attorney, Agent, or Firm*—McGlew and Tuttle

[57] ABSTRACT

To fire a tunnel kiln with coal, the coal is stored in a preferably airtight bunker, and transported, by means of airtightly enclosed conveyor belts or chains connected to the bunker, to coal injectors operating as burners, which are provided in and distributed over the width of the firing zone of the kiln and connected to an air supply line, wherefrom compressed air is fed intermittently into the injectors, to blow in the coal which is there placed in a metered amount.

Each firing place of a kiln is thus formed by a coal injector and the injectors are arranged in rows over the width of the firing zone of the kiln and each row is connected, respectively, by means of an associated conveyor belt and an air distributing pipe, to a conveyor belt extending in the longitudinal direction of the kiln and connecting to the coal bunker, and to a main compressed air line preferably extending parallel thereto. The coal injectors comprise a vertical coal feed tube which is connected to the conveyor belt and is open at its bottom, a receiving plate which is disposed below and spaced from the bottom end of the feed tube, and a casing surrounding the plate and the bottom end of the feed tube and connected to the compressed-air supply line and, through a blow or mixing pipe or directly, to the firing place.

14 Claims, 2 Drawing Figures

METHOD OF FIRING A TUNNEL KILN WITH COAL, AND COAL FIRING INSTALLATION FOR TUNNEL KILNS

FIELD AND BACKGROUND OF THE INVENTION

The invention relates to a method of firing tunnel kilns with coal and to a coal-firing installation for carrying out the method.

Coal-firing of tunnel and of annular kilns is known. In tunnel kilns this method could not operate effectively since the coal poking apparatus, which may even be operable in groups, used for this purpose and their controls include too many mechanisms and therefore are dependent on labor, require assistance and are expensive to maintain. Moreover and primarily, however, what is prohibitive in modern brickworks is the coal dust nuisance. Thus, the coal dust deposits which necessarily would occur with conventional firing methods may effect the properties of electrical switching devices to an extent rendering them eventually inoperable.

SUMMARY OF THE INVENTION

The invention is directed to a method of coal-firing tunnel kilns and an installation for carrying out the method, which would eliminate the drawbacks of prior art coal handling methods and make it possible, with a satisfactory supply of coal fuel, to easily operate brickworks with coal and thus to switch from other solid or gaseous fuels to coal, without having to deal with coal dust and ash troubles.

At the same time, the costs of construction and maintenance are to be minimized, while ensuring a possibility of quite satisfactory adjusting and controlling the firing to the given operational conditions. In the first place, however, the burners are to be operable without maintenance and attendance, so that even a fully automatic operation of the tunnel kiln may be provided.

To this end and in accordance with the invention, the coal is stored in a preferably airtight bunker for accumulating a supply of coal and transported, by means of airtightly enclosed conveyor belts or chains, to coal injectors which are provided in the firing zone of the kiln, distributed over the width thereof, and the coal injectors are connected to an air supply line wherefrom compressed air is admitted or fed into the injectors intermittently, in pulses, to blow the coal stored therein in metered quantities into a firing zone.

The coal-firing installation for tunnel kilns, according to the invention which permits to application of the invention in a very advantageous manner is characterized in that each firing place of a kiln is formed by a coal injector into which the coal can be fed by means of airtightly enclosed conveyor chains or belts connected to a preferably airtight bunker, and which is connected to a compressed-air supply line wherefrom air can be blown into the injector intermittently, in pulses, to eject predetermined amounts of coal, which are stored in the ejector, into the firing zone.

With this design, it is advisable to distribute the coal injectors in rows over the width of the firing zone of the kiln and to connect them, by means of a conveyor belt associated with each row, to a main conveyor belt connected to the coal bunker and extending in the longitudinal direction of the kiln, and, by means of an air distributing pipe associated with each row, to a main compressed-air line preferably extending parallel to the main conveyor belt.

Each coal injector may simply comprise a coal feed tube which is connected to the conveyor belt and open at its bottom, a receiving plate provided below the tube, and a casing which surrounds the lower end of the tube and the receiving plate and is connected to the compressed-air supply line and, through a blow or mixing tube or directly, to the firing zone, and which should be of such design that its cross section perpendicular to its axis has a spiral configuration.

To provide for an easy metering of the coal to be intermittently blown in, it is practical to adjustably mount the receiving plate or the coal feed tube of the coal injector or both for adjustment in height. For the same purpose, however, it is also possible to equip the coal feed tube with an inserted slide cylinder, shut off valve, gate valve, or the like.

In addition, to inject the smallest possible amount of coal in a short period of time, the inlet opening of the casing should be designed as a nozzle having its orifice pointed in the direction of the receiving plate.

To feed the air into each of the coal injectors intermittently, in pulses, metering valves are advantageously associated therewith by which the pulse frequency and/or the recurrent blow period or both can be set, with one common metering valve being associated with one row or group of coal injectors and inserted in the air distributing pipe between the point where the latter is branched off the main compressed-air line, and the first coal injector.

It is further useful to provide suction tubes, preferably adjustable in height, at the end of the kiln and distributed over the width thereof, in order to remove ash which, advantageously, is blown off the car charge by compressed-air blasts.

The inventive coal-firing installation may be utilized with particular advantage in a longitudinal slot-fired tunnel kiln.

The inventive coal-firing method or the corresponding installation make it possible to fire a tunnel kiln with coal without difficulties and without incurring high costs of construction and avoiding troubles with coal dust and ash. That is, if the coal is transported from a bunker by means of airtightly enclosed conveyors to coal injectors which are designed as burners and into which compressed air from a compressed-air line can be introduced intermittently, in a pulsatory manner, very simple means are created for a dust-free transfer of the coal into the firing zones and its introduction in metered amounts and mixed with air into the tunnel kiln, so that a satisfactory combustion is assured and an operation without service and attendance is obtained. Another advantage is that only one metering valve with a high switching frequency and a single moving part is needed for each row of stirring holes or group of burners and that this valve only controls the normal, fresh atmospheric air.

The coal which is supplied in closed containers and stored in a closed main bunker is transferred in a dust-free manner into an intermediate bunker which is provided near the kiln but, as far as possible, outside the works. Therefrom, the coal is transported by an airtightly enclosed upper conveyor chain or another similar conveyor along the firing zone and brought, by means of other conveyor chains provided below the upper conveyor chain and spaced from each other in accordance with the rows of stirring holes, to the individual firing zone designed as coal injectors which are permanently fully charged. In the injectors, a definite amount of coal is formed on the receiving plate by adjusting it in height or by adjusting the vertical position of the feed tube, until the angle of repose is automatically reached and the flow stops. Then, as the metering valve opens, air is blown into the space between the tube and the plate, so that the radially ejected coal, tangentially swept off and mixed with the air, passes into the mixing and blowing tube and falls into the combustion channel proper.

The amount of fuel is controlled by varying the pulse recurrence frequency or the duration of the blast. A highly accurate metering in the individual groups is made possible by providing purely electronic means. Further, a single moving part is present in the entire group of burners, namely a part in the metering valve which does not come into contact with coal, only with the supplied air, so that no difficulties in this respect can arise in operation.

The fire distribution is obtained by predetermining a corresponding mixture of air and more or less coarse coal. The distribution depends on the height of the kiln, and the fire may be controlled in addition, by varying the amount of air.

The coal injectors, as the burners proper, operate without servicing or attendance and, consequently, it is easily possible to provide an automatic operation of tunnel kilns equipped with such a coal firing installation. Also, the charge in the kiln remains dust free and the finely distributed ash may readily be evacuated from the car bottoms, for example, by means of introduced movable tubes reaching close to the car surface and evacuating the ash periodically in accordance with the advance of the cars. The ash nuisance is thereby reduced to a minimum. At the same time, due to the entirely dust free enclosure of the conveyors, any troubles in operation or damages of the electrical installations are eliminated.

In consequence, extreme simplicity as well as reliability in operation and ease in control, which are hard to beat are the distinguishing features of the inventive coal firing installation. The path of the coal is hermetically closed in all directions, so that no dust can penetrate to the outside. The individual firing zones do not include any movable parts, thus has no parts which are to susceptible to wear and which require maintenance. The control is effective in a customary absolutely exact way by a corresponding supply of energy depending only on the temperature at the thermocouple element and only 0.5 to 1 kw is needed for driving the conveyor system.

Since air is added only as coal is actually blown in the combustion chamber, the air consumption is also very small. The inventive installation may thus help to solve the energy problem especially of ceramic brickworks, both economically and in the mode of operation.

An additional favorable effect is that with the inventive method, like earlier in coal fired furnaces, sulphur and partly even fluorine become absorbed in the produced ash particles, which further contributes to the improvement of environmental conditions.

If continuous-type kilns operating with longitudinal slots are equipped with the coal firing installation, it is possible, as already mentioned, to evacuate the produced ash from the cars even before they leave the kiln, and may be to prepare it for use as lean material.

Further particulars of the coal firing installation for tunnel kilns in accordance with the invention may be learned from the embodiment shown in the drawings and are explained in more detail in the following.

DETAILED DESCRIPTION

Figure 1:
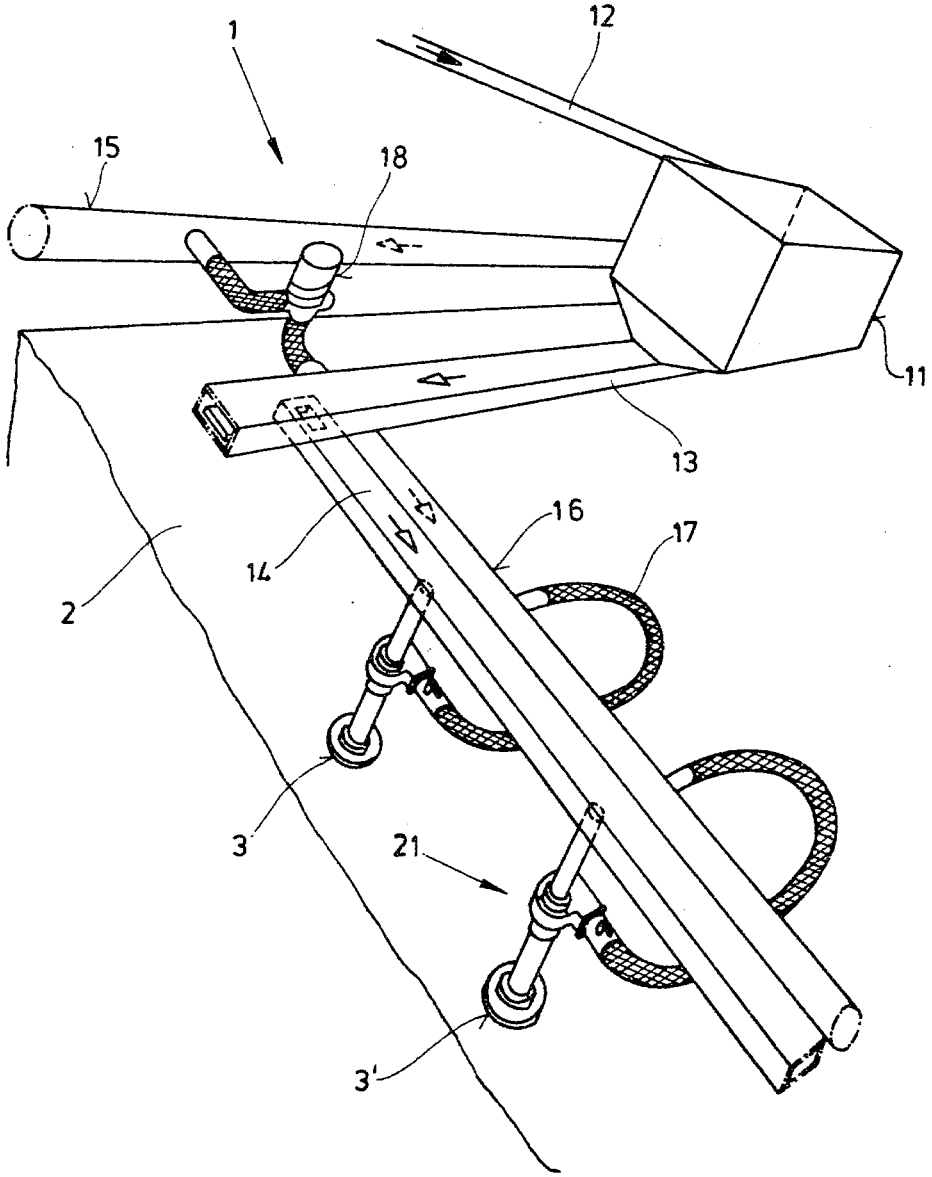
FIG. 1 is a partial perspective view of a tunnel kiln equipped with a coal firing installation.

The tunnel kiln 2 for burning ceramic products such as tiles, drain pipes, checker-bricks, and the like shown in FIG. 1 in a partial perspective view is equipped with a coal firing installation 1. The individual firing places 3, 3' provided in the firing zone of the kiln are formed by coal injectors 21 by means of which meterable coal quantities 4' can be blown into the combustion chamber intermittently, in pulses.

The coal 4 to be burned is transported, by a conveying means 12, from a main bunker (not shown) into an intermediate bunker 11 which is provided at the top level of tunnel kiln 2. From bunker 11, coal 4 is directed by means of a conveyor belt 13 along the firing places and supplied, by other conveyor belts 14 extending transversely thereto and mounted below conveyor belt 13, to the individual firing places 3, 3', or coal injectors 21.

Conveyor belts 13 and 14 running at a low speed are completely and airtightly enclosed and carry the coal 4 from bunker 11 in very small portions of about 1 to 4 kilograms per hour to firing places 3, 3' etc. of tunnel kiln 2. Since conveyor belts 13 and 14 have the property of not becoming clogged, not even in a continuous run, and attain a predetermined filling rate of the apparatus which are installed at their feed end, a reliable and dust-free transportation of coal 4 through coal injectors 21 is insured.

Figure 2:
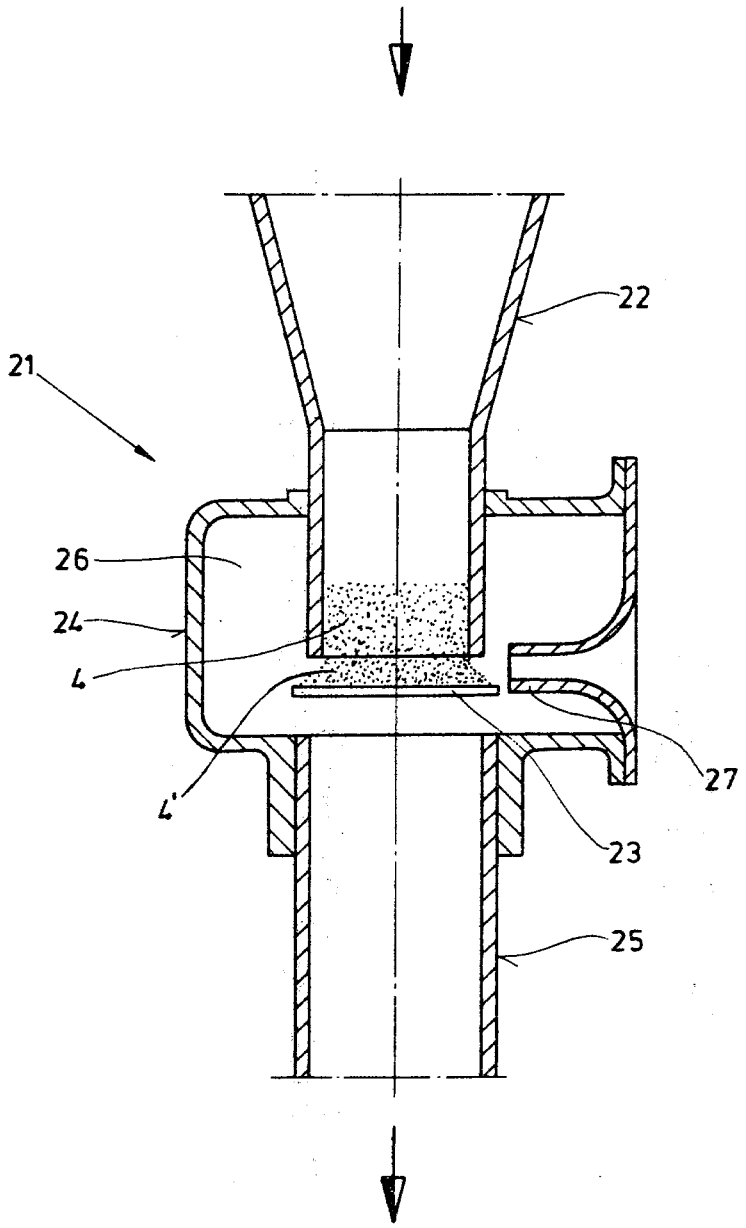
FIG. 2 is a sectional view of a coal injector usable as a burner in the coal firing installation according to FIG. 1.

As may be learned in detail from FIG. 2, each coal injector 21 comprises a vertically extending coal feed tube 22 which in FIG. 2 has a funnel-shape, which is connected to conveyor belt 14 and has an inlet opening at its top and an outlet opening at its bottom, a receiving plate 23 which is disposed below and spaced from the bottom end of tube 22 in the slide path of the coal, and a casing 24 surrounding plate 23 at the bottom end of feed tube 22. A casing 24 for mounting the feed tube surrounds a portion of the lower end of the feed tube. Casing 24 is of spiral shape and forms a mixing chamber with the lower end of the feed tube 26 enclosing plates 23 and having a discharge opening through which a blow tube 25 conveys coal into the firing space. In addition, the casing 24 has an air inlet opening, is designed as a nozzle 27, through which compressed air is directed to plate 23. The nozzle orifice is aligned to direct air in a direction toward the plate 23.

For this purpose, casing 24 is connected, by means of a flexible tube 17, to an air supply pipe 16 which extends transversely to the longitudinal direction of tunnel kiln 2 and, in turn, is connected to a main air supply pipe 15 running parallel to conveyor belt 13 and conveying compressed air which is produced, for example, by a fan. To feed the air to coal injector 21 intermittently, in pulses, a controllable metering valve 18 is inserted in each of the air distributing pipes 16 upstream of the injectors and downstream of the location where the pipes 16 are branched off main air supply pipe 15.

By means of metering valve 18, air pulses are distributed to the individual coal injectors 21 in such a way that the coal received on plate 23 is suddenly blown away. Any duration of the blast may be set by means of valve 18 and at the instant the air blast is stopped again by valve 18, plate 23 is refilled up to the angle of repose, with an amount of coal 4' which can be adjusted by appropriately spacing plate 23 from coal feed tube 22.

Since plate 23 is mounted for adjustment in height, the height of the coal layer thereon can be varied, so that the quantity of coal to be fed to the individual firing zones can be metered in a simple manner. This control of the quantity is absolutely necessary to obtain a uniform burnign across the travelling direction. The proportion between the central and outer rows of a kiln is to be adjusted by positioning a plate.

Consequently, up to attaining the angle of repose, the coal will fall down and remain on plate 23. If now an air pulse is produced under the control of metering valve 18, the coal is blown away, that is tangentially swept off plate 23 and, at the same time, mixed with air in the spiral mixing chamber 25 and blown through blow tube 25 connected thereto into the firing slot. This insures an optimum mixing of fine dust, which is always produced, and more or less coarse coal in the firing space, corresponding to the fire height and fire distribution. There are various possibilities of adjusting the fire height. Either the coal may be supplied from the mines in the proper grain proportion, or an additional control effect may be obtained by means of the air, or still another possibility of exactly adapting to the requirements of a specific kiln may be a suitable design of the blow pipe 25.

The ash necessarily produced with a coal firing method is a troublesome extra, of course, and undesirable especially in tunnel kilns. The application of the inventive method or coal firing installation 1, however, makes it possible to provide, for example, at the end of the tunnel kiln, some pipes projecting into the firing slots and held under vacuum, through which the ash may continually be evacuated from the cars. Advantageously, prior to that, the ash is blown off the charge by blasts of compressed-air, and then the air ash mixture is taken out. To prevent the ash from passing into the sand channel, a pressure zone may be produced thereabove, with the pressure being slightly in excess of the kiln pressure.

I claim:

1. A method of firing a tunnel kiln with coal, the tunnel kiln being of the type having an air-tight bunker for accumulating a supply of coal, injectors at spaced locations over the firing zone of the kiln, an air-tight enclosed conveyor connecting the air-tight bunker and the injectors, and means for injecting air under pressure through an opening in the injectors in pulses, which comprises the steps of accumulating a supply of coal in the air-tight bunker, transporting the coal by means of the air-tight enclosed conveyor to the coal injectors, and selectively injecting air under pressure through the opening in the injectors in pulses to blow the coal therefrom in metered quantities into the firing zone.

2. A coal firing installation for firing a firing zone of an elongated tunnel kiln with coal comprising an air-tight bunker for accumulating a supply of the coal, a coal injector for storing a quantity of the coal, air-tight conveyor means connecting said air-tight bunker and said injector for passing coal from said bunker to said injector, said coal injector having an inlet opening through which compressed air can be introduced therein and a discharge opening through which the coal can be passed to the firing zone, and means for selectively admitting compressed air into said injector in pulses through said inlet opening to pass a predetermined amount of coal stored in the injector into the firing zone.

3. A coal firing installation as set forth in claim 2, wherein said coal injector comprises a plurality of coal injectors distributed loads over the width of the firing zone in the kiln, said conveyor means comprises a conveyor belt connected to each row and a main conveyor belt connected to each of said conveyor belts and to said bunker and extending in the longitudinal direction of the kiln, and said compressed air admitting means comprises an air distributing pipe connected to each row of injectors and a main compressed air line connected to each air distributing pipe and a source of compressed air and extending parallel to the main conveyor belt.

4. A coal firing installation as set forth in claim 3, wherein each coal injector comprises a vertical coal feed tube having an inlet opening at the top for receiving the coal from said conveyor belt and an outlet opening at its bottom, a receiving plate disposed below said tube outlet opening at a vertically spaced location, and a casing which surrounds the lower end of said tube and said receiving plate, means connecting the casing to the compressed air source, and said casing having a discharge opening for passing the coal to the firing zone.

5. A coal firing installation as set forth in claim 4, wherein said casing in its cross-section perpendiculary to its vertical axis has a spiral configuration.

6. A coal firing installation as set forth in claim 5, where at least one of said receiving plates in said coal feed tube are adjustably mounted for adjusting the height of the vertical space in between.

7. A coal firing installation as set forth in claim 5, further comprising means in said feed tube for metering the amount of coal to be blown in pulses.

8. A coal firing installation as set forth in claim 7, wherein said metering means comprises a slide cylinder.

9. A coal firing installation as set forth in claim 5, wherein said means for connecting said casing to the compressed air source includes a nozzle having its orifice pointed in the direction of said receiving plate.

10. A coal firing installation as set forth in claim 5, further comprising a metering valve in each air supply pipe upstream of the injectors, said metering valve being operable to regulate at least one of the pulse frequency and the blow period of the compressed air to said row of the injectors.

11. An ejector for storing and delivering coal to a firing space in a tunnel kiln comprising a vertically disposed funnel shaped feed tube with an inlet opening at the top for receiving the coal and an outlet opening at the bottom for delivering the same, a receiving plate mounted below said outlet opening in the slide path of the coal at a vertically spaced location from said outlet opening for receiving a predetermined amount of the coal, a casing for mounting said feed tube surrounding a portion of the lower end of said feed tube and said receiving plate, said casing defining with said portion of the lower end of said feed tube a mixing chamber, said casing having a discharge opening for passing coal to the firing space, and means for selectively admitting air under pressure into said mixing chamber to blow the coal received on said receiving plate through said mixing chamber and said discharge opening to the firing space.

12. A coal firing installation for firing a firing zone of an elongated tunnel kiln with coal comprising an air-tight bunker for accumulating a supply of coal, a plurality of coal injectors for storing and delivering a quantity of the coal to the firing zone, air-tight conveyor means for passing said coal from said bunker to said injectors, and each of said injectors comprising a vertically disposed feed tube with an inlet opening at the top for receiving the coal and an outlet opening at the bottom for delivering the same, a receiving plate mounted below said outlet opening in the slide path of the coal at a spaced location from said outlet opening for receiving a predetermined amount of the coal, a casing for mounting said feed tube surrounding a portion of the lower end of said feed tube and said receiving plate, said casing defining with said portion of the lower end of said feed tube a mixing chamber, said casing having a discharge opening for passing the coal to the firing space, and means for selectively admitting air under pressure into said mixing chamber to blow said predetermined amount of coal received on said receiving plate through said mixing chamber and discharge opening to the firing space.

13. A coal firing installation as set forth in claim 12, wherein a plurality of said coal injectors are distributed in rows over the width of the firing zone and said conveyor means comprises a conveyor belt connected with each row and a main conveyor belt connected to each of said conveyor belts and to said bunker.

14. A coal firing installation as set forth in claim 12, wherein at least one of said receiving plates and said feed tube are adjustably mounted for adjusting the height of the vertical space therebetween.

* * * * *